US005356048A

United States Patent [19]

Geiser

[11] Patent Number: 5,356,048

[45] Date of Patent: Oct. 18, 1994

[54] BULK STORAGE TANK WITH ACCESS PANEL

[75] Inventor: Richard L. Geiser, Goshen, Ind.

[73] Assignee: CTB, Inc., Milford, Ind.

[21] Appl. No.: 99,227

[22] Filed: Jul. 29, 1993

[51] Int. Cl.[5] ..... B67D 5/06; E04H 7/00

[52] U.S. Cl. ..... 222/185; 222/460; 52/196; 220/327

[58] Field of Search ..... 222/181, 185, 460; 220/315, 318, 327, 328; 52/196, 204.1, 192; 49/463, 466; 141/331

[56] References Cited

U.S. PATENT DOCUMENTS

| | | | |
|---|---|---|---|
| 700,769 | 5/1902 | Hazard | 49/463 X |
| 1,788,998 | 1/1931 | Glass | 220/327 |
| 2,370,799 | 3/1945 | Kelley | 220/327 X |
| 2,457,066 | 12/1948 | Peppersack | 220/327 |
| 2,597,682 | 5/1952 | Snow | 220/327 |
| 3,028,998 | 4/1962 | Malik et al. | 222/185 X |
| 3,460,710 | 8/1969 | Vogeli | 220/327 |
| 3,910,173 | 10/1975 | Zepponi | 222/460 X |

*Primary Examiner*—Andres Kashnikow
*Assistant Examiner*—Kenneth DeRosa
*Attorney, Agent, or Firm*—Trexler, Bushnell, Giangiorgi & Blackstone, Ltd.

[57] ABSTRACT

A bulk storage tank is disclosed having an access opening in a lower funnel portion with a removable cover plate. The access opening is located and shaped for permitting a workman to access or partially enter the interior of the tank.

8 Claims, 2 Drawing Sheets

BULK STORAGE TANK WITH ACCESS PANEL

The present invention relates to a novel storage tank and, more particularly, to a novel storage tank for bulk materials, such as grains, feeds, and industrial granulated or powdered materials.

Bulk storage tanks of the type contemplated herein are frequently quite large and usually include an upper cylindrical section providing the desired storage capacity, and a lower funnel portion having a lower discharge end joined with means, such as an auger system, for removing material from the tanks. Such tanks usually include an access opening in the top thereof through which the tank is filled with bulk material to be stored, and also through which a workman can enter in the event internal maintenance or cleaning is required. Since such tanks can be quite large, it is frequently difficult and dangerous for a workman to enter the top and climb down toward the bottom to perform necessary maintenance work.

SUMMARY OF THE INVENTION

It is an important object of the present invention to provide a novel bulk storage tank having a lower funnel portion with an access opening through which a workman can at least partially enter for performing maintenance or cleaning work, particularly at the lower end of the tank.

A further object of the present invention is to provide a novel storage tank having a relatively simple and economical access panel in a lower funnel portion thereof, which access panel may be readily removed and replaced.

A still further object of the present invention is to provide a novel bulk storage tank of the above-described type having an access panel in a lower funnel portion thereof constructed and secured in a manner so as to minimize interruptions in the internal surface of the funnel portion, whereby to promote flow of bulk material from the tank and minimize any tendency of bridging.

A still further object of the present invention is to provide a novel bulk storage tank of the above-described type, having an access panel structure constructed and secured in a manner for maintaining structural integrity of the tank.

A more detailed object of the present invention is to provide a novel bulk storage tank having an access panel structure located toward a lower discharge end thereof, whereby a workman standing on the ground or a floor may have ready access to the interior of the tank without fully entering the tank.

Other objects and advantages of the present invention will become apparent from the following description and the accompanying drawings.

DESCRIPTION OF AN ILLUSTRATIVE EMBODIMENT OF THE INVENTION

Figure 1:
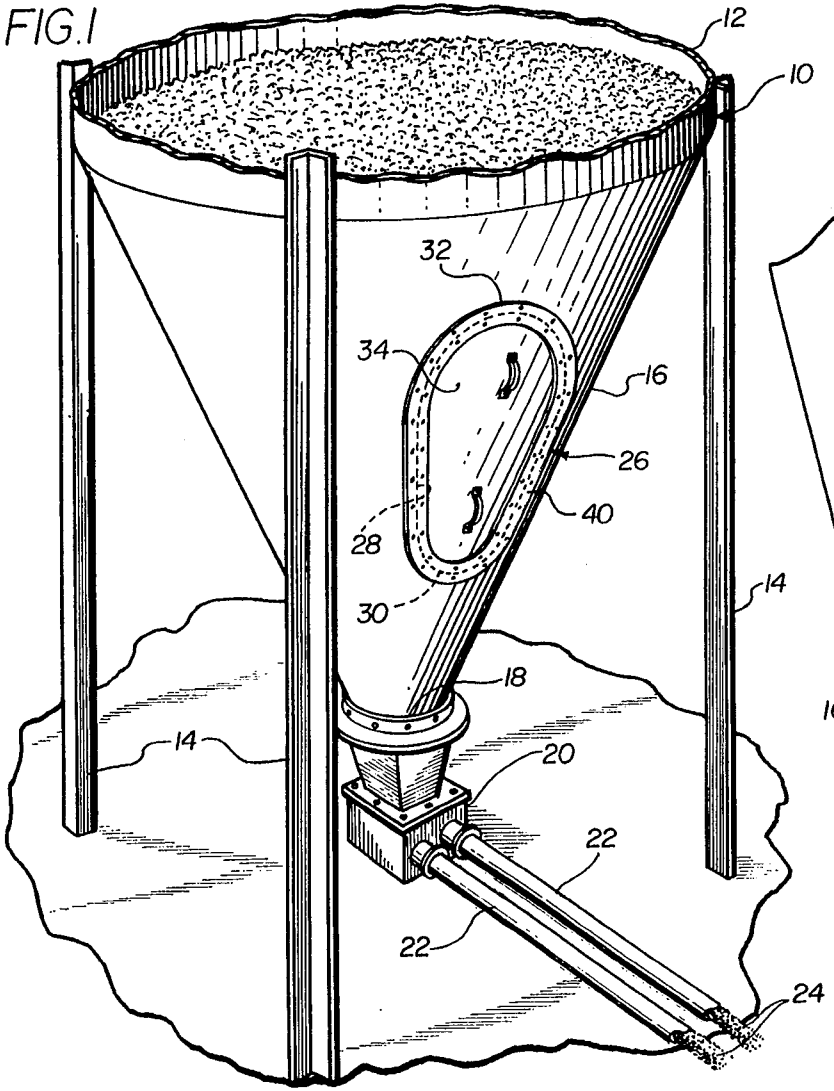
FIG. 1 is a perspective view showing a novel bulk storage tank incorporating features of the present invention.

Referring now more specifically to the drawings, wherein like parts are designated throughout the various figures, a bulk storage tank 10 incorporating features of the present invention is shown in FIG. 1. The storage tank comprises an upper cylindrical portion 12 usually formed from a plurality of plates bolted, welded, or otherwise secured together to provide a storage compartment having the desired capacity. As is well-known, such cylindrical tanks are frequently formed from sheets of corrugated galvanized steel. The tank is supported in an upright position by a plurality of legs 14 extending to the floor or ground. In certain installations, the tank could be suspended from above, rather than supported on the ground.

The storage tank also includes a downwardly tapering funnel portion 16 extending with a progressively decreasing circumference from the upper tank section 12 to a lower discharge end 18. While the tank and funnel portions 12 and 16 are shown as having a circular cross-section, it is to be understood that they could be constructed with a polygonal or any other desired cross-section. In any event, the funnel section 16, like the tank section 12, is usually constructed from a plurality of sections or plates bolted or otherwise secured together. Usually such plates are formed from galvanized sheet steel. While, as indicated above, the tank portion 12 of the bulk storage tank 10 may be formed from corrugated sheet material, the downwardly tapering funnel portion is preferably formed from sheets having a smooth interior surface for promoting free flow of the bulk material down through the funnel section and minimizing any tendency of bridging.

The lower discharge opening or end 18 of the funnel portion is adapted to be connected with various well-known mechanisms for withdrawing bulk material from the tank and delivering the material to a suitable point of discharge. As indicated above, storage tanks incorporating the features of the present invention may be used for a wide variety of materials, such as animal feeds, grain, and granulated or powdered industrial materials. In the embodiment shown in FIG. 1, for the purposes of illustrating the present invention, the funnel outlet 18 is connected with an auger system, including a boot 20 connected directly to the funnel, and one or more discharge tubes 22 in which auger conveyors 24 are driven in a known manner.

Figure 2:
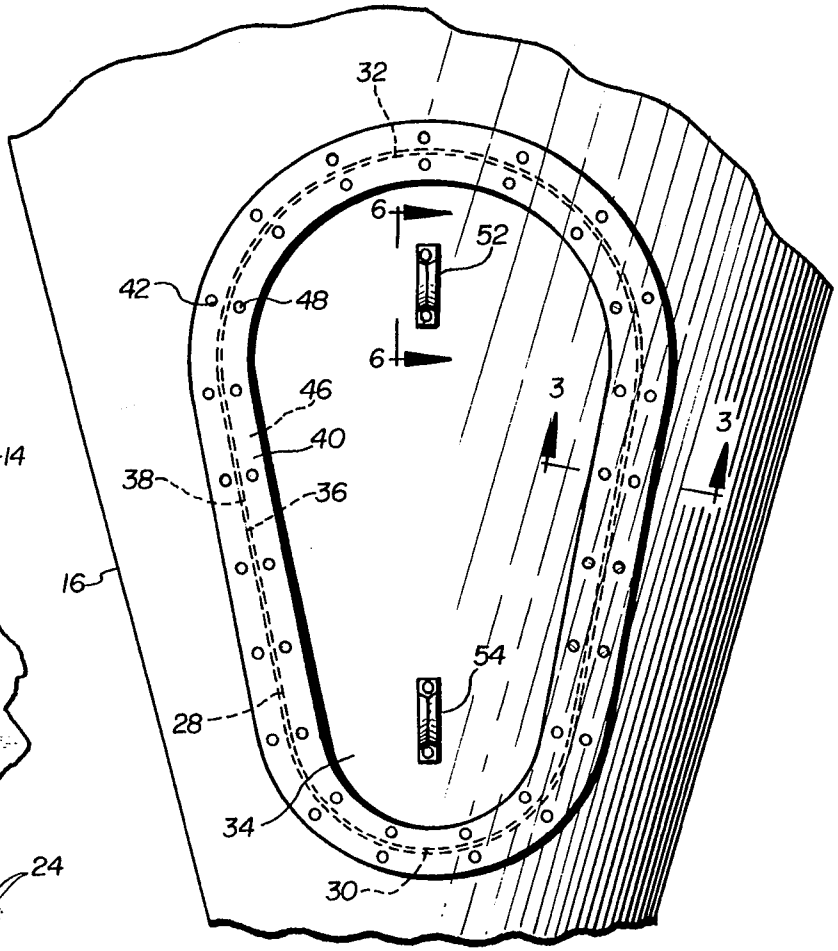
FIG. 2 is an enlarged fragmentary side elevational view of a funnel portion of the storage tank, including an access panel structure incorporating features of the present invention.

In accordance with the present invention, the bulk storage tank 10 is provided with an access panel structure 26 in the funnel portion 16. The structure 26 includes an opening 28, cut or otherwise formed, in the wall of the funnel section 16. As shown in FIGS. 1 and 2, the opening .28 has a lower end 30 preferably located sufficiently close to the lower end of the funnel portion 16, so that a workman standing on the ground can have access to the opening. The opening 28 extends upwardly from the lower end 30 to an upper end 32, which is preferably sufficiently high above the ground so that a workman may at least project his head and shoulders through the opening sufficiently to perform required maintenance within the tank or even in connection with the discharge conveyor mechanism. It will be noted that the opening has its maximum width toward the upper end 32 to facilitate entry of the workman at least partially into the tank. However, the width of the opening gradually decreases toward the lower end 30, along with the gradually decreasing circumference of the funnel portion 16, so as to promote maintenance of the structural integrity of the funnel portion. While the size and shape of the opening 28 may vary with the size and cross-section or configuration of the funnel portion 16, one embodiment of the invention preferably has an opening which is approximately 32 to 36 inches long or high and 14 to 18 inches wide at its maximum width. The thickness of the sheet material from which the funnel portion is fabricated will also vary with the size of the tank. In general, the wall of the funnel portion is preferably made of sheet material between about 12 and 20 gauge.

Figure 3:
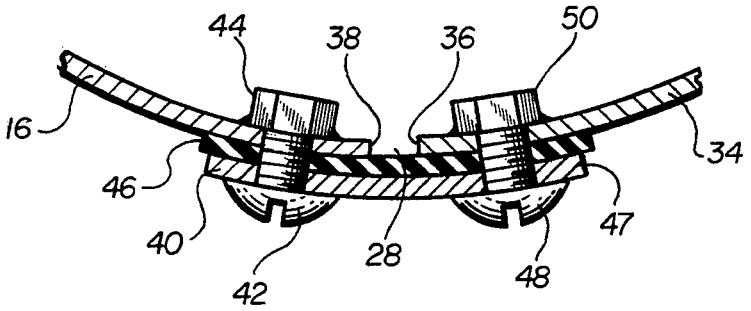
FIG. 3 is an enlarged fragmentary sectional view taken along line 3—3 in FIG. 2.
Figure 4:
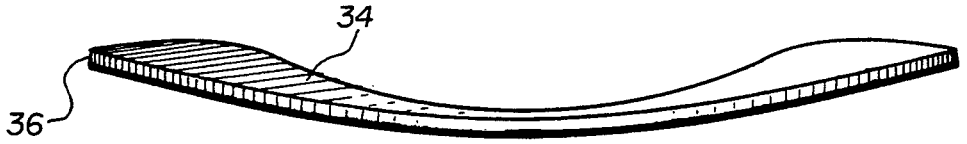
FIG. 4 is an upper end view of an access cover or plate included in the structure incorporating features of the present invention.
Figure 5:
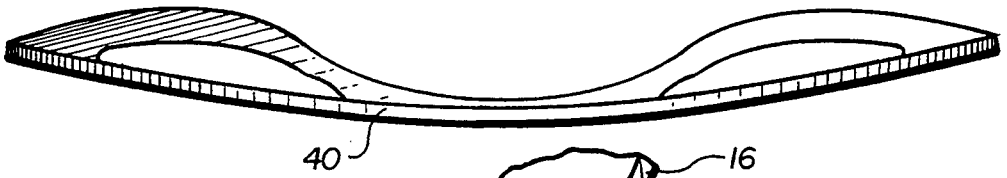
FIG. 5 is an upper end view of a frame member constructed for surrounding an access opening in a lower funnel portion of the tank.

An access panel or plate 34 is provided, which plate has a peripheral edge 36 with a configuration and size similar to an edge 38 of the opening 28, as indicated in FIGS. 2 and 3. Furthermore, the horizontal cross-sectional configuration of the plate 34 is complementary in geometry to that of the portion of the funnel in which the opening 28 is formed. In other words, in the embodiment shown, the funnel 16 has a circular cross-section or configuration, and the panel 34 has a cross-section which is arcuate and complementary to the circular cross-section of the panel. Furthermore, the panel 34 is mounted, as will be described in more detail below, so that the inner surfaces of the funnel wall and the panel 34 at the substantially abutting edges 36 and 38 are substantially smooth projections of each other. Thus, the interior surface of the panel 34, which is preferably made of sheet material of the same gauge as the wall of the funnel portion 16, provides a smooth continuation of the interior surface of the funnel portion 16, whereby to promote flow of the material being dispensed and to minimize any tendency of bridging.

The access panel structure is provided with a frame 40 extending around the margins 38 and 36 of the opening 28 and the panel 34. In the illustrative embodiment shown herein, the frame 40 is a separate sheet material member, preferably of galvanized steel, which overlaps both the margin of the opening 28 and the margin of the panel or cover plate 34, as shown in FIGS. 2 and 3. The frame 40, which is preferably made of sheet material of about 14 gauge, is fixed securely to, and reinforces, the wall of the funnel portion. A plurality of bolts 42 secure the frame in place, which bolts extend through aligned apertures in the frame 40 and the funnel wall, and are threaded into nuts 44 welded or otherwise secured to the interior surface of the funnel wall. As shown best in FIG. 2, the bolts 42 are spaced in a row which extends entirely around the periphery of the opening 28. It is to be understood that other known fastening devices may be used for securing the frame 40 with respect to the funnel portion 16. Preferably a sealing gasket 46 is disposed so as to be clamped between opposing surfaces of the frame member 40 and funnel wall so as to seal the opening when the cover plate 34 is installed.

As shown in FIGS. 2 and 3, the frame member 40 has an inner marginal portion 46 providing a lip which projects inwardly of the edge or mouth 38 of the opening 28 to provide a support for the panel or cover 34. As shown in FIG. 2, the panel 34 is supported so that it provides a continuation of the inner surface of the funnel portion 16. The cover plate 34 is removably secured in position by another row of bolts or fasteners 48 extending through aligned apertures in the frame member and the panel 34, and threaded into nuts 50, welded or otherwise fixed to the inner surface of the panel 34. It is understood that other types of known disconnectable or quick release fasteners could be used in place of the bolts 48 and nuts 50. The gasket 46 is extended so as to extend between opposing surfaces of the frame portion 47 and the removable cover plate 34, so as to provide a seal.

Figure 6:
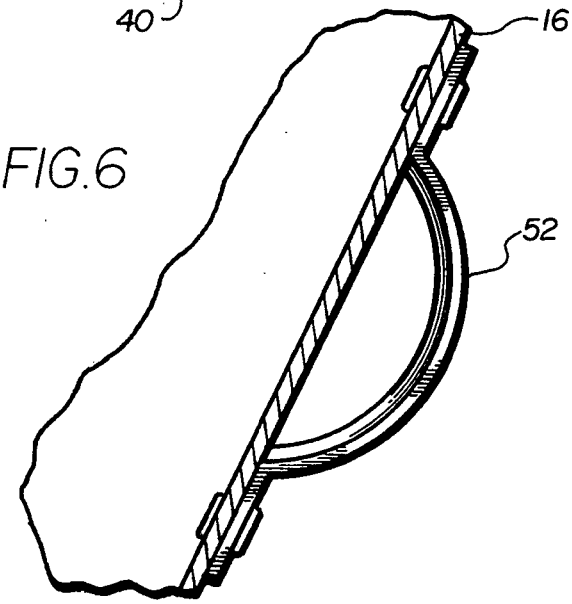
FIG. 6 is an enlarged fragmentary sectional view taken line 6—6 in FIG. 2.

In order to remove the panel 34, it is necessary to disconnect all of the fasteners 48. The panel is then manually manipulated and turned so that it can be withdrawn end first through the opening 28. Since the opening and the panel are formed with a length which is greater than the width, such manipulation can be easily accomplished. Furthermore, handles 52 and 54 are secured by suitable fasteners or welding to the outer surface of the cover panel, as shown in FIGS. 2 and 6, for facilitating manual manipulation of the cover panel during assembly with, or removal from, the funnel portion 16 of the tank.

While a preferred embodiment of the present invention has been shown and described herein, many structural details may be changed without departing from the spirit and scope of the appended claims.

The invention is claimed as follows:

1. A combination, including a bulk storage tank for particulate bulk material comprising a lower end funnel portion having a side wall of decreasing circumference, means defining a vertically elongated access opening in said side wall through which a workman may bodily project into the interior of said funnel portion for maintenance purposes, a lip around and projecting inwardly of a margin of said opening, a cover disposed within said lip and covering said opening, fastening elements releasably securing said cover to said lip, said funnel portion including a lower discharge outlet, and discharge conveyor means connected to and communicating with said discharge outlet.

2. A combination, as defined in claim 1, wherein said cover and said opening margin have inner surfaces constituting smooth projections of each other.

3. A combination, as defined in claim 1, wherein said lip comprises a frame member separate from said funnel wall and secured to an outer surface of said funnel wall.

4. A combination, as defined in claim 3, which includes a sealing gasket between said frame member and outer surfaces of said funnel wall and said cover.

5. A bulk storage tank for particulate bulk materials comprising a cylindrical upper end portion and a lower funnel portion having a side wall of progressively decreasing circumference and a lower discharge end opening adapted to be connected to discharge conveyor means communicating with said discharge end opening, means defining an access opening in said side wall having a lower end adjacent said discharge end opening of the funnel portion, said access opening increasing in width from adjacent a lower end to adjacent an upper end thereof for enabling a workman to project at least a portion of his body through said opening for performing maintenance, a removable cover plate complementary to and disposed in said opening, said side wall and said cover plate including opposing margins having inner surfaces constituting smooth projections of each other, and a frame extending around said opening and said cover plate and joined to said funnel portion side wall, said frame being disposed outwardly of said inner surfaces, said cover plate being joined to said frame.

6. A tank, as defined in claim 5, wherein said frame comprises a member separate from said side wall.

7. A tank, as defined in claim 6, wherein said frame member is separate from said cover plate, said tank further including releasable fasteners releasably joining said cover plate to said frame member.

8. A tank, as defined in claim 7, which includes handle means connected to said cover plate for facilitating manipulation of the cover plate during assembly with and disassembly from said funnel portion.

* * * * *